US010132037B2

(12) United States Patent
Strengell et al.

(10) Patent No.: US 10,132,037 B2
(45) **Date of Patent: *Nov. 20, 2018**

(54) STABILIZED SIZING FORMULATION

(71) Applicant: Kemira Oyj, Helsinki (FI)

(72) Inventors: Reetta Strengell, Espoo (FI); Juha Lindfors, Espoo (FI); Sari Hyvärinen, Espoo (FI); Sauli Vuoti, Espoo (FI)

(73) Assignee: Kemira Oyj, Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 15/116,660

(22) PCT Filed: Feb. 6, 2015

(86) PCT No.: PCT/FI2015/050075

§ 371 (c)(1),
(2) Date: Aug. 4, 2016

(87) PCT Pub. No.: WO2015/118227

PCT Pub. Date: Aug. 13, 2015

(65) Prior Publication Data

US 2016/0348316 A1 Dec. 1, 2016

(30) Foreign Application Priority Data

Feb. 6, 2014 (FI) ..... 20145117

(51) Int. Cl.

| | |
|---|---|
| ***D21H 17/24*** | (2006.01) |
| ***D21H 17/16*** | (2006.01) |
| ***D21H 17/17*** | (2006.01) |
| ***D21H 17/31*** | (2006.01) |
| ***D21H 21/16*** | (2006.01) |

(52) U.S. Cl.

CPC ..... *D21H 17/24* (2013.01); *D21H 17/16* (2013.01); *D21H 17/17* (2013.01); *D21H 17/31* (2013.01); *D21H 21/16* (2013.01)

(58) Field of Classification Search

CPC ..... D21H 17/24; D21H 17/17; D21H 21/16; D21H 17/31

USPC ..... 162/175

See application file for complete search history.

(56) References Cited

U.S. PATENT DOCUMENTS

| | | | | |
|---|---|---|---|---|
| 4,606,773 | A | 8/1986 | Novak | |
| 6,093,217 | A | 7/2000 | Froelich | |
| 2007/0074641 | A1 | 4/2007 | Dyllick-Brenzinger et al. | |
| 2009/0188054 | A1 | 7/2009 | Dyllick-Brenzinger | |
| 2010/0016478 | A1 | 1/2010 | Brockmeyer et al. | |
| 2010/0209725 | A1 | 8/2010 | Kataja | |
| 2012/0135050 | A1* | 5/2012 | Dill | A61K 31/122 424/400 |
| 2012/0164193 | A1* | 6/2012 | Dill | A61K 9/284 424/400 |
| 2012/0244221 | A1* | 9/2012 | Dill | A61K 9/284 424/484 |

FOREIGN PATENT DOCUMENTS

| | | | |
|---|---|---|---|
| CN | 1726320 | A | 1/2006 |
| CN | 102199899 | A | 9/2011 |
| CN | 102421842 | A | 4/2012 |
| CN | 102852034 | A | 1/2013 |
| EP | 1314822 | A1 | 5/2003 |
| JP | 2000-509448 | A1 | 4/2000 |
| WO | 9951816 | A1 | 10/1999 |
| WO | 99/55736 | A2 | 11/1999 |
| WO | 2004007839 | A1 | 1/2004 |
| WO | 2005070912 | A1 | 8/2005 |
| WO | 2008103123 | A2 | 8/2008 |
| WO | 2008145828 | A1 | 12/2008 |
| WO | 2010/108206 | A1 | 9/2010 |

OTHER PUBLICATIONS

Finnish Patent and Registration Office Search report of FI Patent application No. 20145117 dated Aug. 29, 2014.

State Intelletual Property Office, P.R. China, Office Action dated Sep. 18, 2017 issued in CN patent appln. No. 201580007509.1.

Japan Patent Office, English translation of Office Action issued on JP2016-549464, dated Apr. 10, 2018.

State Intellectual Property Office, P.R. China, Second Office Action issued for patent appln. No. 201580007509.1 dated Jul. 10, 2018.

* cited by examiner

*Primary Examiner* — Mark Halpern

(74) *Attorney, Agent, or Firm* — Berggren LLP

(57) ABSTRACT

The present invention relates to sizing agent formulations, especially to stabilizing a sizing formulation by a modified non-food polysaccharide. The method for preparation of the modified non-food polysaccharide is further provided.

13 Claims, 2 Drawing Sheets

STABILIZED SIZING FORMULATION

PRIORITY

This application is a National Entry under 35 U.S.C. section 371 of International Application number PCT/FI2015/050075 filed on Feb. 6, 2015 and claiming priority of Finnish national application number FI20145117, filed on Feb. 6, 2014, the contents of both of which are incorporated herein by reference.

FIELD OF THE INVENTION

The present invention relates to papermaking, and especially to a stabilized sizing formulation to be used in the paper manufacture and to a method for sizing paper.

BACKGROUND ART

Sizing makes the native fiber network hydrophobic and thus prevents or reduces the penetration of water or other aqueous liquids into the paper. Sizing prevents the spreading and strike through of ink or printing colors. Papermaking fibers have a strong tendency to interact with water. This property is important for the development of strong interfiber hydrogen bonds, especially during drying, and is also the reason why paper loses its strength when rewetted. A high absorbency is important for certain paper grades such as toweling and tissue. Also corrugated medium paper must be able to absorb to a certain degree to convert properly in the corrugating process. On the other hand such properties are disadvantageous for many paper grades, e.g., liquid packaging, top layer of corrugated board, writing and printing papers, and most specialty papers. The water and liquid absorbency can be reduced by the addition of sizing agents to the paper stock and/or by their application to the paper surface.

Since the 1950s various forms of rosin size in the form of paste, dispersed, fortified formulations, alkyl ketene dimer (AKD) size, alkenyl succinic anhydride (ASA) size, and polymers mainly based on styrene acrylate and styrene maleinate sometimes called polymeric sizing agents (PSAs), have come onto the market. Today, beside starch for paper strength improvement and polymer binders for paper coating, sizing agents are the most important quality-improving additives in the paper manufacturing.

When applied in papermaking an emulsion or a dispersion of the sizing agent is prepared. Among other uses in papermaking, cationized starch is commonly used also as a stabilizing agent of the sizing agent emulsions or dispersions.

Pure starch is a white, tasteless and odorless powder that is insoluble in cold water or alcohol. It consists of two types of molecules: the linear and helical amylose:

(1)

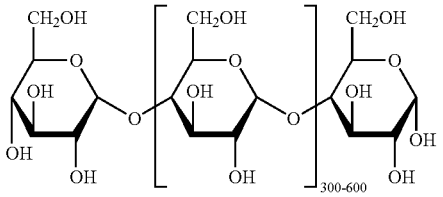

and the branched amylopectin:

(2)

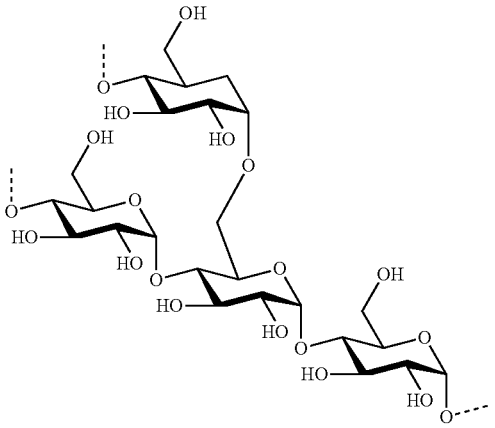

Depending on the plant origin of starch, it generally contains from 20% to 25% amylose and from 75% to 80% amylopectin by weight.

Starch plays a dominant role amongst chemical additives that are used for the manufacturing and upgrading of paper and board. Starch derivatives are mainly used for dry-strength improvement of paper and board and as binders for pigment coating, and also for wet-end addition for dry-strength improvement as well as improvement of filler and fines retention, and application in surface sizing, pigment coating, and converting adhesives.

Galactomannans are polysaccharides consisting of a mannose backbone with galactose side groups. A segment of galactomannan showing mannose backbone with a branching galactose unit on the top is illustrated below.

(3)

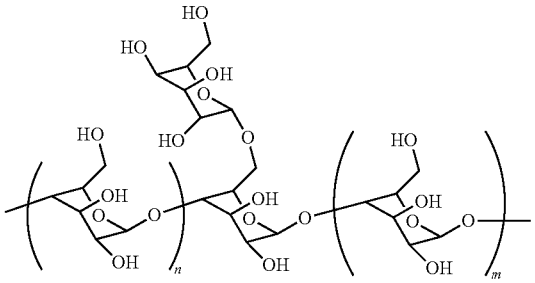

Non-ionic galactomannans such as guar gum have been used in emulsions of ASA sizing agent under controlled conditions. These ASA—guar gum emulsions were subjected to various treatments using a deposition rotor. Typically, the more guar gum is used in the emulsion, the more stable is the emulsion. The use of a further surfactant results in even less deposition, and a smaller average particle size of the emulsion.

In U.S. Pat. No. 4,606,773 an emulsion of alkenyl succinic anhydride (ASA) type of paper sizing agent is prepared using a cationic water-soluble polymer and a cationic starch as an emulsifiers. In the disclosed method a water-soluble polymer is used as an emulsification aid. A cationically modified polymer having a molecular weight ranging between 20.000-750.000 is used in conjunction with water-soluble cationic starch, wherein the cationic starch to polymer weight ratio is between 75:25 to 25:75.

In the application of cationized starch for ASA stabilization typically a ratio from 1:1 to 4:1 of starch to ASA is used. Furthermore, starch used is also an important source of nutrition. Therefore, to develop more sustainable solutions for the future it would be highly advantageous to develop and use sizing agents comprising non-food based chemicals as emulsifiers in papermaking.

SUMMARY OF THE INVENTION

The object of the present invention is to provide a stable sizing agent formulation for use in paper and paper product manufacture.

A further object of the present invention is to provide a sizing agent formulation the components of which are of non-food origin thus rendering the sizing agent formulation more sustainable in use.

Yet, a further object of the present invention is to provide a more efficient stabilizing agent for use in sizing formulations.

The present invention provides modified derivatives of non-food, anti-nutritional polysaccharides. The modified polysaccharides are successfully used as stabilizers in sizing formulations, especially suitable for paper and paper product manufacture according to the present invention.

Typically starch has been used as stabilizer for the sizing agents. The present invention provides an attractive more sustainable alternative for starch which alternative is of non-food origin. For technical purposes environmentally benign biopolymers should be used instead of nutritionally important starch.

One advantage in replacing starch with a non-food anti-nutritional polysaccharide is that more starch is rendered available for nutritional purposes.

Another advantage of the method and product of the present invention is that the concentration of the non-food polysaccharides required to provide the necessary stabilizing effect for the sizing formulation is remarkably lowered compared to other stabilizers thus providing an enhanced stabilization effect. Therefore, considerably less polysaccharides according to the present invention are needed compared, for example, to the amount of starch required. This may further lower the preparation cost of the sizing agent emulsions, and eventually also the cost for sizing agent formulation.

Yet, another advantage in providing the required stabilizing effect with using less stabilizing agent is that the amount of chemicals needed in subsequent processing may be decreased, as well.

When starch is used as a stabilizer it is not fully retained in the paper. Unretained material will be contained in the eluents of the papermaking process. Therefore, the use of starch will increase the organic load of the wastewater of a papermaking process. When modified non-food polysaccharides, xylan or arabinogalactan, according to the present invention are used the amount of stabilizer needed is considerably lower lowering the organic load in the wastewaters, as well.

The present invention provides a method for preparation of modified non-food polysaccharides providing an enhanced stabilizing effect in sizing formulation.

The present invention further provides a stabilized sizing formulation and a method for preparation thereof. The use of the formulation is depicted, as well.

DETAILED DESCRIPTION

Figure 1:
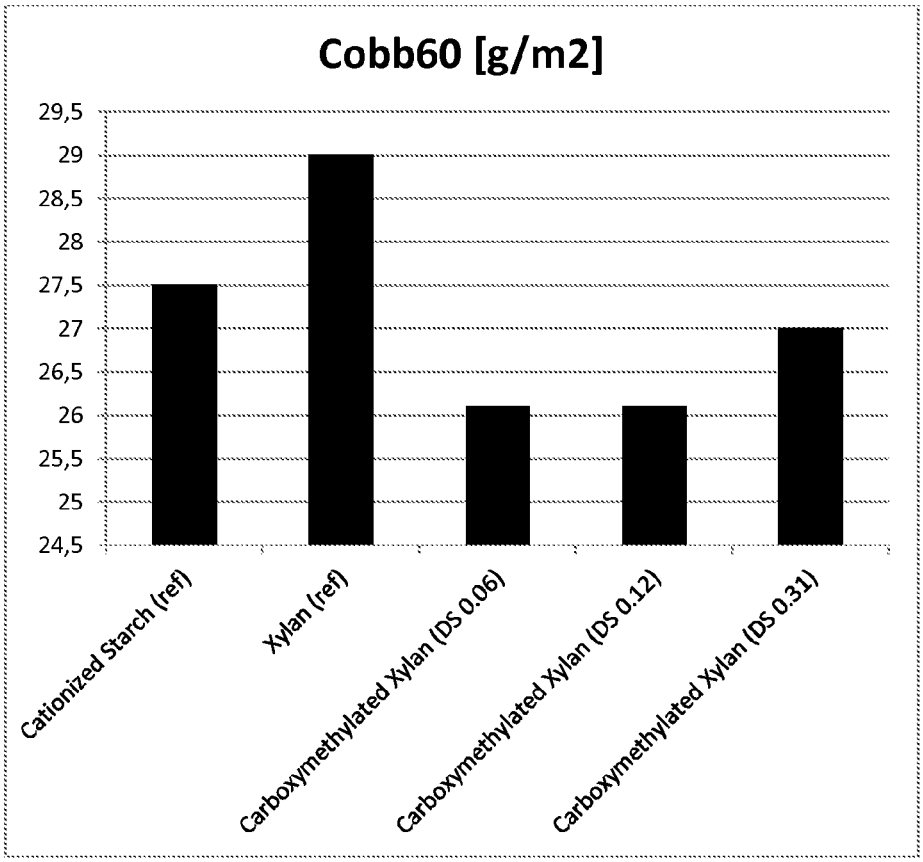
FIG. 1 shows sizing results (Cobb60) of stabilized sizing formulations of the present invention comprising a sizing agent and an anionic derivative of xylan.

By non-food polysaccharides is meant polysaccharides which fail to provide a source for a nutritional diet. Unlike starch, non-food polysaccharides cannot be used for nutritional purposes.

The non-food polysaccharides include indigestible non-starch polysaccharides (NSP) consisting of long chains of repeating glucose units. However, unlike starches, the glucose units in non-starch polysaccharides are joined by beta-acetal linkage bonds. The beta-acetal linkage cannot be split by the enzymes in the digestive tract. The non-starch polysaccharides include, for example, celluloses, hemicelluloses, gums, pectins, xylans, mannans, glucans and mucilages. Typical NSPs found in wheat are arabinoxylans and cellulose. Preferably, the non-food polysaccharides of the present invention are selected from xylan, arabinogalactan or mixtures thereof.

In one embodiment the stabilized sizing formulation of the present invention comprises a sizing agent and a modified non-food polysaccharide which comprises xylan or arabinogalactan or mixtures thereof.

Xylan (CAS number: 9014-63-5) is one example of highly complex polysaccharides that is found in plant cell wall and in certain algae. Xylan is a polysaccharide made from units of xylose which is a pentose sugar. Xylans are almost as ubiquitous as cellulose in plant cell walls and contain predominantly β-D-xylose units linked as in cellulose. The formula of a xylan may be presented as follows:

(4)

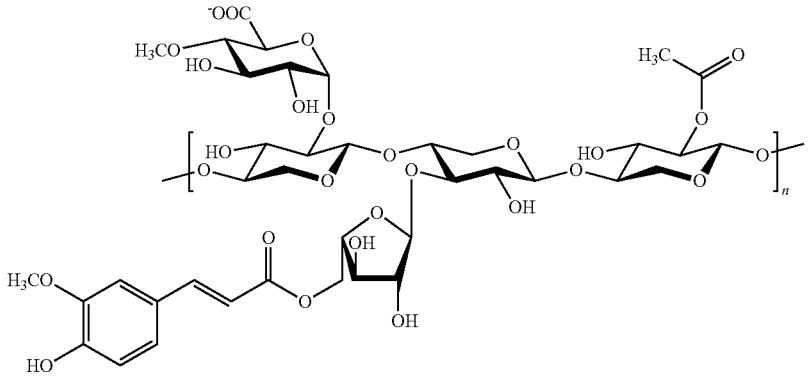

wherein n is the number of xylose units.

Another specific example of a non-food polysaccharide is arabinogalactan. It is a biopolymer consisting of arabinose and galactose monosaccharides. Two classes of arabinogalactans are found in nature: plant arabinogalactan and microbial arabinogalactan. In plants, it is a major component of many gums, including gum arabic and gum ghatti. Both the arabinose and galactose exist solely in the furanose configuration. An example of a structure of an arabinogalactan is presented by the following formula:

(5)
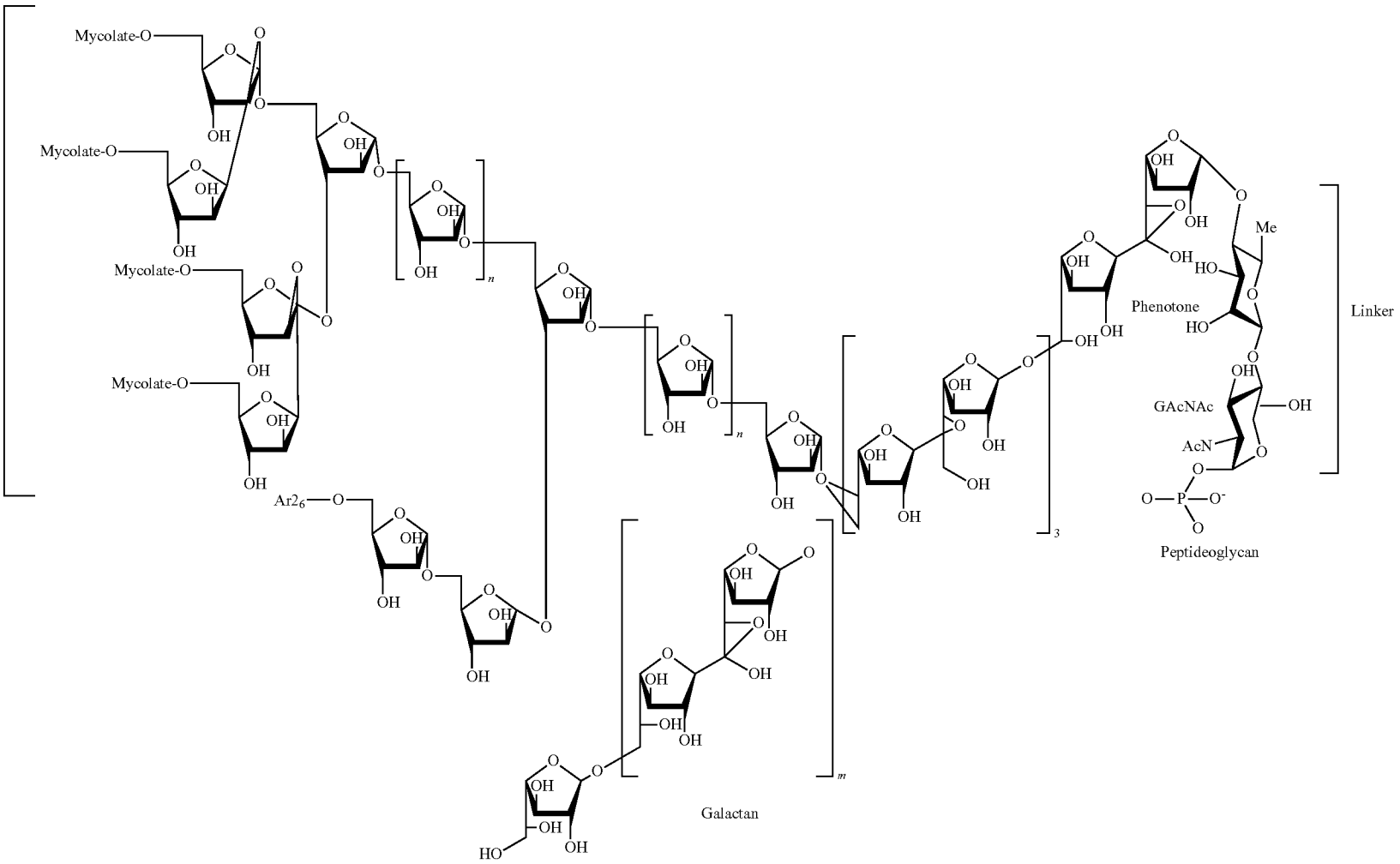

An arabinogalactan from wood of the larch tree (Larix laricina) is composed of d-galactose and l-arabinose in a 6:1 molar ratio accompanied by small amounts of d-glucuronic acid. Arabinogalactans are found in a variety of plants but are more abundant in Larix occidentalis (western larch).

In one aspect of the present invention a method for preparation of a modified non-food polysaccharide is provided. The properties of non-food polysaccharides may be modified by functionalizing or derivatizing with varying chemicals. The properties of the modified polysaccharides, such as hydrophobicity and/or plasticization, may be enhanced further by modifying them with esters and/or ether groups into the hemicellulose backbone. Depending on the quality of the substituents, the degree of substitutions, type of backbone, molecular weight of the remaining backbone, solubility and thermal properties can be changed remarkably and the dispersion properties enhanced even further.

The disclosed method comprises modifying the non-food polysaccharide by functionalization using a functionalizing agent which is capable of charging the non-food polysaccharide. The non-food polysaccharides may be modified to exhibit cationic or anionic properties. There are several methods available for carrying out this charging.

The non-food polysaccharide of the present invention is charged by rendering it anionic with a suitable anionization reagent. This method for anionic charging the non-food polysaccharide comprises the steps of i. providing a suspension of the non-food polysaccharide and an alcohol;
ii. introducing aqueous base solution to the mixture of step i., and stirring the resulting mixture at room temperature;
iii. introducing anionization reagent, such as carboxymethyl reagent, to the mixture of step ii., and stirring the resulting mixture at elevated temperature; and
iv. washing and filtering the resulting anionically charged derivative of the non-food polysaccharide before recovery.

In one embodiment of the present invention the anionic non-food polysaccharide derivative preferably contains carboxymethyl groups with a high degree of substitution. These anionically charged derivatives of non-food polysaccharides are prepared by reaction of the non-food polysaccharide preferably with monochloro acetic acid in varying reaction media. The reaction of monochloro acetic acid with the non-food polysaccharide proceeds more rapidly at higher temperatures than in room temperature.

In a preferred reaction method according to the present invention the anionically charged derivatives of non-food polysaccharides are prepared by reacting the non-food polysaccharide with a carboxymethyl reagent. The non-food polysaccharide is suspended in an alcohol, preferably ethanol. Aqueous base solution is introduced into the suspension and resulting mixture is preferably vigorously stirred at room temperature, preferably at least 1 hour. To this mixture the carboxymethyl reagent is introduced and resulting mixture is stirred at elevated temperature, preferably at least 2 hours. The resulting product is poured to excess amount of water, neutralized and purified by filtration, preferably ultrafiltration (CutOff 1000).

In one embodiment the non-food polysaccharide comprises xylan or arabinogalactan or mixtures thereof.

Preferably, the base is metal hydroxide, more preferably NaOH or KOH, even more preferably NaOH, and most preferably 50% aqueous NaOH solution. The carboxymethyl reagent is preferably monochloro acetic acid. Preferably, the elevated temperature is from 35 to 65° C., more preferably from 45 to 55° C., such as about 50° C.

The preferred non-food polysaccharides to be anionized in the present invention are xylan and arabinogalactan or a mixture thereof.

The anionization reagents may be selected from commercially available reagents.

In one embodiment xylan is anionized using monochloro acetic acid as anionization reagent. Xylan is suspended into ethanol. 50% aqueous NaOH solution is added to the suspension and resulting mixture is vigorously stirred at room temperature for 1 hour. Monochloro acetic acid is added to the mixture and stirred at 50°C. for two 2 hours. The resulting product is poured to excess amount of water, neutralized and purified by filtration.

The reaction mechanism is the following:

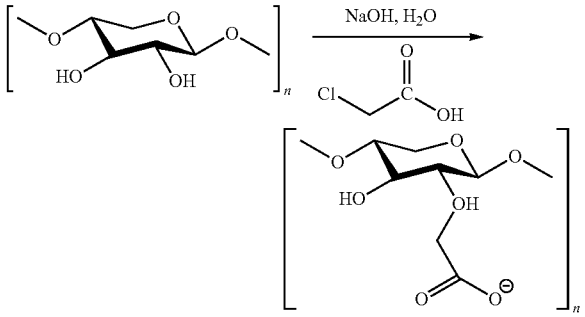

In another embodiment arabinogalactan is anionized using monochloro acetic acid as anionization reagent. Arabinogalactan is suspended into ethanol. 50% aqueous NaOH solution is added to the suspension and resulting mixture is vigorously stirred at room temperature for 1 hour. Monochloro acetic acid is added to the mixture and stirred at 50° C. for two 2 hours. The resulting product is poured to excess amount of water, neutralized and purified by filtration.

Degree of substitution (DS) of the anionically charged derivatives of non-food polysaccharides is dependent on the reagents, reagent ratios and reaction conditions. The degree of substitution may be determined by potentiometric titration know for a skilled person.

The degree of substitution of the anionically charged derivatives of non-food polysaccharides is preferably from 0.03 to 1.0. The degree of substitution in the monochloro acetic acid charged xylan is preferably from 0.03 to 0.60, and more preferably from 0.06 to 0.31, whereas for monochloro acetic acid charged arabinogalactan preferably from 0.03 to 0.60, and most preferably from 0.11 to 0.42.

In another aspect of the present invention a stabilized sizing formulation is provided comprising a sizing agent and an anionically charged non-food polysaccharide.

The sizing agent of the formulation is preferably alkyl ketene dimer (AKD), alkenyl succinic anhydride (ASA) or mixtures thereof. The amount of ASA in the formulation is from 0.5 to 5.0 weight-%, preferably from 1.0 to 3.0% by weight, more preferably from 1.0 to 2.0% by weight, even more preferably from 1.0 to 1.50% by weight, and most preferably from 1.24 to 1.26% by weight of the formulation.
weight, more preferably from 1.0 to 2.0% by weight, even more preferably from 1.0 to 1.50% by weight, and most preferably from 1.24 to 1.26% by weight of the formulation.

In one embodiment the stabilized sizing formulation comprises ASA or AKD, and an anionized xylan. The polysaccharide is most advantageously anionized using carboxymethyl reagent, such as monochloro acetic acid, and preferably the degree of substitution is less than 1.0, more preferably from 0.03 to 0.60, and most preferably from 0.06 to 0.31.

In another preferred embodiment the stabilized sizing formulation comprises ASA or AKD, and an anionized arabinogalactan. The polysaccharide is most advantageously anionized using carboxymethyl reagent, such as monochloro acetic acid, and preferably the degree of substitution is less than 1.0, more preferably from 0.03 to 0.60, and most preferably from 0.11 to 0.42.

The amount of charged functionalized non-food polysaccharide to the sizing agent in the stabilized sizing formulation is from 0.05:1 to 0.15:1, preferably from 0.07:1 to 0.13:1, more preferably from 0.09:1 to 0.11:1. These amounts are considerably less than the corresponding amounts of starch required and tested as reference. The amount of starch required to provide the same stabilizing effect was about 20 times more.

The stabilized sizing formulation according to the present invention is preferably in a form of a dispersion, more preferably an emulsion.

In one embodiment the amount of ASA in the sizing emulsion formulation is 1.25% by weight and the amount of xylen anionically modified with carboxymethyl reagent, preferably monochloro acetic acid, to ASA is about 0.1:1.

In another embodiment the amount of ASA in the sizing emulsion formulation is 1.25% and the amount of arabinogalactan anionically modified with carboxymethyl reagent, preferably monochloro acetic acid, to ASA is 0.1:1.

The formulation according to the present invention may further contain typically used, or readily commercially available, emulsifiers or retention aids, such as e.g. Fennopol K 3400 R.

The dosage of the sizing agent formulation according to the present invention to the pulp is preferably from 0.5 to 3 kg/t when the formulation comprises the charged non-food polysaccharide stabilizing agent.

In a further aspect of the present invention a method for preparing the stabilized sizing formulation is provided. The sizing agent and the charged non-food polysaccharide are brought into contact within an aqueous solution whereby a dispersion is formed.

In one embodiment the cationic noon-food polysaccharide is first dissolved into water or an aqueous solvent whereto the sizing agent is subsequently introduced. The mixture is then homogenized. The sizing agent is preferably mixed with an aqueous solution of the charged non-food polysaccharide to ensure efficient mixing.

Preferably, the sizing formulation is formed by homogenizing the aqueous mixture. The homogenization may be carried out in high pressure, preferably at a pressure from 140 to 160 bar.

In a yet further aspect of the present invention use of the stabilized sizing formulation as depicted above is provided for sizing paper and paper products. A preferred dosage amount of the sizing formulation into pulp furnish is from 0.5 to 3 kg/t.

The sizing efficiency of the sizing formulation may be evaluated by preparing handsheets and measuring the Cobb value of the paper product resulting from a manufacturing process utilising the sizing formulation. The Cobb60 value determines the water absorptiveness of sized paper according to ISO 535:1991(E) standard.

Using the stabilized sizing formulation according to the present invention Cobb60 values are lower to the values obtained when using starch as stabilizer. Thus, it is possible to replace starch stabilized sizing formulations with formulations comprising non-food polysaccharides without sacrificing the stabilizing ability or the quality of the final paper product.

It is further noted that the amount of charged modified non-food polysaccharide may be clearly less, possibly 1/10 or even 1/20, than the amount of starch needed, to reach equal results. The amount of the stabilizing agent in the emulsions of sizing formulations could be significantly lower, such as 1/20 of that compared to starch as a stabilizer. This has a particular effect on the effluent water chemical load and to the post processing and recycling of the effluent.

Hereafter, the present invention is described in more detail and specifically with reference to the examples, which are not intended to limit the present invention.

EXAMPLES

Preparation of Anionic Xylan by Carboxymethylating the Xylan

Three samples with varying degree of substitution are prepared from the non-food polysaccharide, xylan.

Xylan was suspended in ethanol. 50% aqueous NaOH solution was added to the suspension and reaction mixture was vigorously stirred at room temperature for 1 hour. 80% monochloro acetic acid (MCAOH) was added to the reaction mixture, and temperature of the reaction bath was raised to 50° C. After 2 hours resulting product was precipitated from water, filtrated and washed with aqueous ethanol (70%) and finally washed with pure ethanol prior drying.

For specific amounts of reagents, see Table 1 for details. All the reagents are commercially available.

Preparation of Anionic Arabinogalactan by Carboxymethylating the Arabinogalactan.

Two samples with varying degree of substitution are prepared from the nonfood polysaccharide, arabinogalactan.

Arabinogalactan was suspended in ethanol. 50% aqueous NaOH solution was added to the suspension and reaction mixture was vigorously stirred at room temperature for 1 hour. 80% monochloroacetic acid (MCAOH) was added to the reaction mixture, and temperature of the reaction bath was raised to 50° C. After 2 hours resulting product was poured to excess amount of water, neutralized and purified by ultrafiltration (CutOff 1000).

For specific amounts of reagents, see Table 1 for details. All the reagents are commercially available.

Analysis of the Synthesized Anionic Xylans and Anionic Arabinogalactans

Degree of substitution (DS) of the synthesized anionic xylans and arabinogalactans was measured by potentiometric titration. Degradation temperatures ($T_{10\%}$) of the samples were also measured.

In table 1 are presented degrees of substitutions and degradation temperatures of the synthesized anionic xylans and anionic arabinogalactans.

TABLE 1

| Sample Code | Non-food polysaccharide (g) | MCAOH (g) | NaOH (g) | Ethanol (g) | DS (potentiometric titration) | Degradation temperature (° C.) |
|---|---|---|---|---|---|---|
| CM_X311 | Xylan (30 g) | 4.5 | 7 | 120 | 0.12 | 257 |
| CM_X411 | Xylan (30 g) | 3.0 | 5 | 120 | 0.06 | 255 |
| CM_X711 | Xylan (30 g) | 7.5 | 10 | 120 | 0.31 | 259 |

TABLE 1-continued

| Sample Code | Non-food polysaccharide (g) | MCAOH (g) | NaOH (g) | Ethanol (g) | DS (potentiometric titration) | Degradation temperature (° C.) |
|---|---|---|---|---|---|---|
| CM_Ag111 | Arabinogalactan (30 g) | 7.5 | 10 | 120 | 0.42 | 228 |
| CM_Ag211 | Arabinogalactan (30 g) | 2.0 | 3 | 120 | 0.11 | 213 |

Preparation of the Stabilized Sizing Formulations

ASA emulsions are prepared using a kitchen blender with 2 min mixing, after which they are passed through a homogenizer at 150 bar pressure.

Firstly, sizing emulsion is prepared from 1.25% ASA emulsions using anionized xylan from table 1 to ASA ratio of 0.1:1 as stabilizer.

Secondly, sizing emulsion is prepared from 1.25% ASA emulsions using anionized arabinogalactan from table 1 to ASA ratio of 0.1:1 as stabilizer.

As a reference sizing emulsion is prepared also from starch (Raisamyl 50021) and 1.25% ASA emulsion using starch to ASA ratio of 2:1 as stabilizer. Further reference samples are made from 1.25% ASA emulsions using xylan and arabinogalactan without anionization in ratios of 0.1:1 as stabilizers.

Preparation of Laboratory Handsheets, and Sizing Results

Laboratory handsheets, 80 g/m$^2$, are prepared by introducing into 50/50 hardwood/softwood Kraft pulp furnish having a pH 8.5 the stabilized sizing formulations prepared in above example. No fillers are used in the resulting paper processing and the wet end starch amount is 5 kg/t. The stabilized size formulation dosage is 0.75 kg/t. K 3400R (200 g/t) is used as a retention aid.

The results from Cobb60 testing are depicted in FIG. 1 for anionic xylan stabilized sizing agent formulation, and further depicting the reference sample results for cationic starch and xylan.

Figure 2:
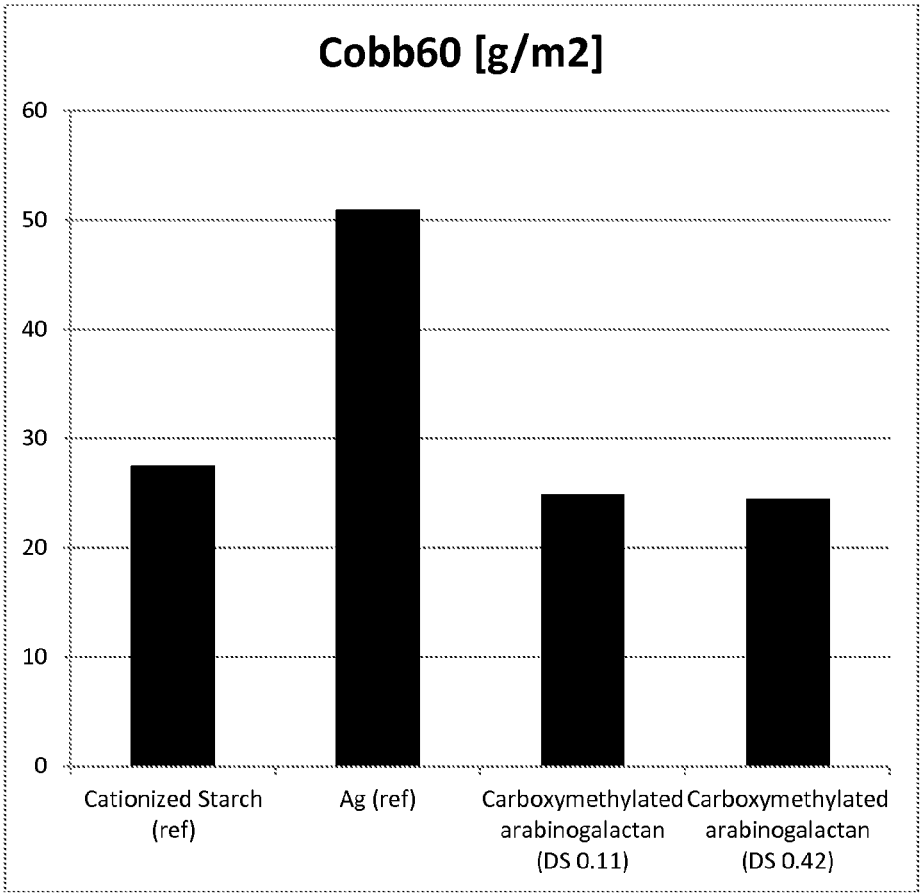
FIG. 2 shows sizing results (Cobb60) of stabilized sizing formulations of the present invention comprising a sizing agent and an anionic derivative of arabinogalactan.

The results from Cobb60 testing are depicted in FIG. 2 for anionic arabinogalactan stabilized sizing agent formulation further depicting the reference sample results for cationic starch and arabinogalactan.

The smaller the Cobb60 number the better the sizing, i.e. the paper product is more hydrophobic and absorbs less water.

FIG. 1 shows that the paper sheets wherein anionized xylan is used are more hydrophobic than cationic starch based sizing agent.

FIG. 2 shows that the paper sheets wherein anionized arabinogalactan is used are more hydrophobic than cationic starch based sizing agent.

The invention claimed is:

1. A stabilized sizing formulation, comprising a sizing agent and an anionically charged derivative of a non-food polysaccharide which comprises xylan or arabinogalactan or a mixture thereof, wherein the non-food polysaccharide is selected from the group consisting of celluloses, hemicelluloses, gums, pectins, xylans, mannans, glucans and mucilages.

2. The formulation according to claim 1, wherein the sizing agent is alkyl ketene dimer (AKD) or alkenyl succinic anhydride (ASA) or a mixture thereof.

3. The formulation according to claim 1, wherein the anionically charged derivative of the non-food polysaccharide is obtained by modifying the non-food polysaccharide with carboxymethyl reagent.

4. The formulation according to claim 3, wherein, the carboxymethyl reagent is monochloro acetic acid.

5. The formulation according to claim 4, wherein degree of substitution of the anionically charged derivative of the non-food polysaccharide from 0.03 to 1.0.

6. The formulation according to claim 1, wherein the non-food polysaccharide is xylan or arabinogalactan or mixtures thereof.

7. The formulation according to claim 1, wherein said formulation is in a form of a dispersion.

8. The formulation according to claim 7, wherein the dispersion is an emulsion.

9. The formulation according to claim 1, wherein ratio of the anionically charged derivative of the non-food polysaccharide to the sizing agent is from 0.05:1 to 0.15:1.

10. A method for preparing the stabilized sizing formulation of claim 1, wherein the sizing agent and the anionically charged derivative of the non-food polysaccharide comprising xylan or arabinogalactan or a mixture thereof are brought into contact within a solution whereby a dispersion is formed by homogenization at a pressure from 140 to 160 bar.

11. A method to sizing paper and paper products, said method comprising the steps of obtaining formulation of claim 1 and sizing paper and paper products with the formulation.

12. The method according to claim 11, wherein dosing of the stabilized sizing formulation into pulp is from 0.5 to 3 kg/t.

13. A method for preparation of the anionically charged derivative of the non-food polysaccharide of claim 1 comprising the steps of:

i. providing a suspension of the non-food polysaccharide comprising xylan or arabinogalactan or a mixture thereof and an alcohol;

ii. introducing aqueous base solution to the mixture of step i., and stirring the resulting mixture;

iii. introducing carboxymethyl reagent to the mixture of step ii., and stirring the resulting mixture at elevated temperature; and iv. washing and filtering the resulting anionically charged derivative of the non-food polysaccharide before recovery.

* * * * *